United States Patent [19]

Smith

[11] 4,058,162

[45] Nov. 15, 1977

[54] WELL TOOL ADAPTED TO BE LOCKED WITHIN AND SEALED WITH RESPECT TO THE BORE OF THE WELL CONDUIT

[75] Inventor: Jerry D. Smith, Houston, Tex.

[73] Assignee: Cameron Iron Works, Inc., Houston, Tex.

[21] Appl. No.: 679,509

[22] Filed: Apr. 22, 1976

[51] Int. Cl.[2] ..... E21B 23/02; E21B 33/129

[52] U.S. Cl. ..... 166/124; 166/135; 166/139

[58] Field of Search ..... 166/135, 139, 124, 192, 166/217

[56] References Cited

U.S. PATENT DOCUMENTS

| | | | |
|---|---|---|---|
| 2,939,534 | 6/1960 | Allen | 166/86 |
| 2,975,836 | 3/1961 | Brown | 166/217 |
| 3,042,116 | 7/1962 | Sharp et al. | 166/224 A |
| 3,179,279 | 4/1965 | Bradley et al. | 166/135 |
| 3,180,420 | 4/1965 | Manson, Jr. et al. | 166/217 |
| 3,250,331 | 5/1966 | Boyle | 166/217 |
| 3,338,308 | 8/1967 | Elliston et al. | 166/216 |

*Primary Examiner*—James A. Leppink
*Attorney, Agent, or Firm*—W. F. Hyer; Marvin B. Eickenroht

[57] ABSTRACT

There is disclosed well apparatus which comprises a well conduit having a bore therethrough and a well tool having means thereon for releasably locking it within and sealing it with respect to the bore of the well conduit when lowered therein.

26 Claims, 3 Drawing Figures

Figure 1:
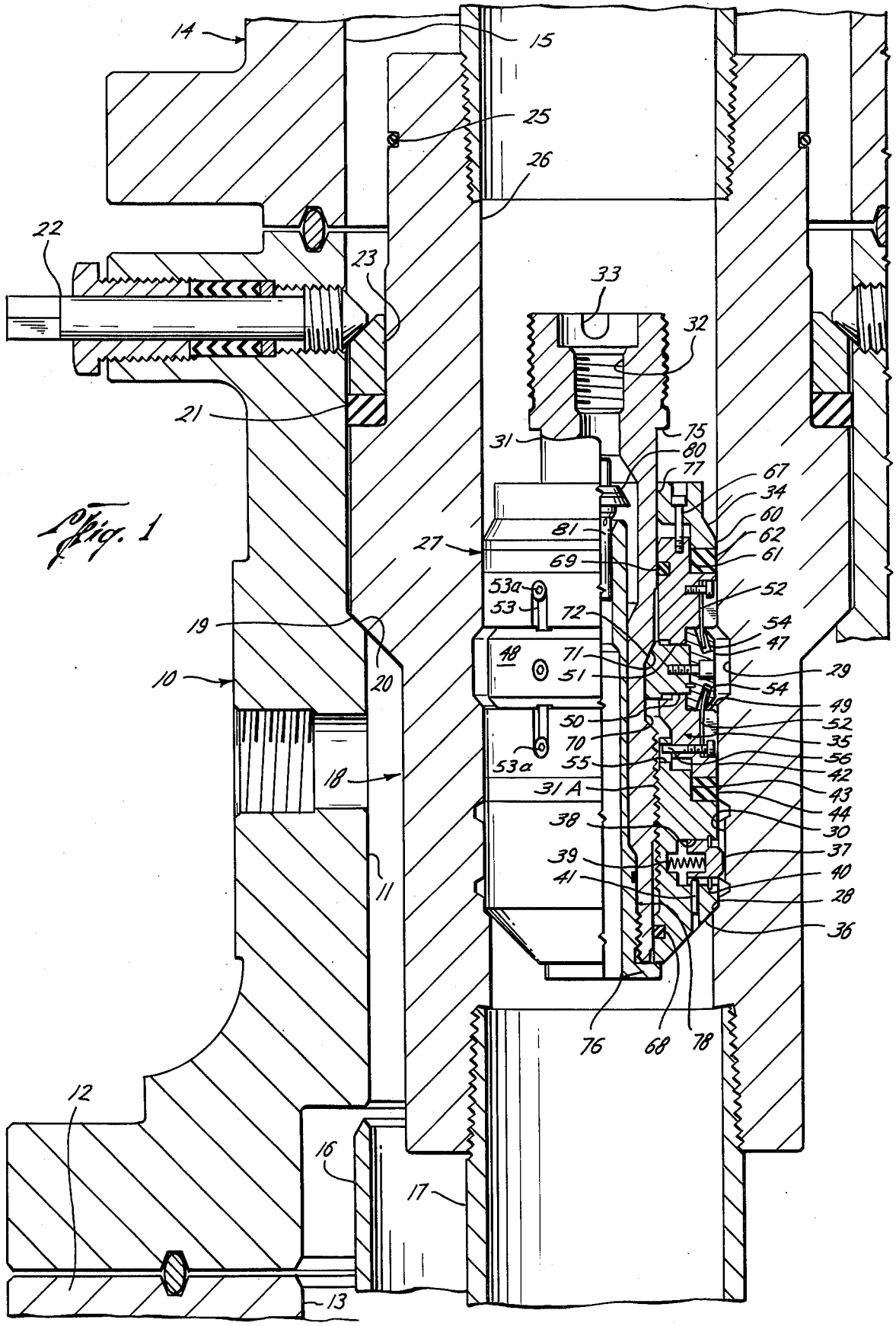

WELL TOOL ADAPTED TO BE LOCKED WITHIN AND SEALED WITH RESPECT TO THE BORE OF THE WELL CONDUIT

This invention relates generally to well apparatus; and, more particularly, to improvements in well apparatus of the type which includes a well tool which may be releasably locked within and sealed with respect to the bore of a well conduit.

As shown, for example, in U.S. Pat. No. 2,939,534, the well tool may comprise a check valve adapted to be lowered through a blowout preventer stack to permit it to be releasably locked within and sealed with respect to the bore of a tubing hanger supported within a wellhead on which the stack is mounted. The check valve thus seals off well pressure within the tubing suspended from the hanger so that the preventer stack may be removed and a Christmas tree or cap (when the well is not to be produced) installed on the wellhead.

As disclosed in such earlier patent, the check valve is manipulated by means of a running string having a tool on its lower end which includes a stinger adapted to hold the valving element in its open position, and thereby equalize pressure thereacross, as the check valve is lowered into position within the tubing hanger bore. Then, when the running tool has been manipulated to cause the check valve to be locked and sealed within the bore and then withdrawn with the running string, the stinger is lifted from the valving element to permit the check valve to close and thus seal off the bore. In some cases, the valving element of check valves of this type may also be adapted to prevent flow in a downward direction, whereby they permit the Christmas tree to be tested by means of test pressure above the check valve.

The check valve shown in U.S. Pat. No. 2,939,534 is locked within the bore of the tubing hanger by means of threads on its outer circumference engageable with matching threads on the bore of the hanger, and a seal ring is carried about the valve above the threads thereon in position to be extruded into sealing engagement with the bore of the hanger as they are made up with the hanger threads. The torque required to manipulate the running tool in order to install the valve in this manner is excessive in large size valves.

In another apparatus of this type, the well tool carries locking means in the form of locking dogs which are spring-pressed outwardly so as to fit within a locking groove in the bore of the well conduit, and thus land the tool therein, and one or more seal rings which form an interference seal with the bore as it is lowered into landed position. During lowering of the tool into landed position, both the locking dogs and the seal rings may be damaged by obstructions in the bore. Also, in the event the locking dogs do not move outwardly into the locking grooves in the well conduit bore, the tool may be blown out of the bore when the seal rings seal therewith to form a closure thereacross.

An object of this invention is to provide apparatus of this type in which the well tool may be installed without such large torque requirements, and with the assurance that it is locked therein before sealing with respect to the bore of the conduit.

Another object is to provide such apparatus in which the locking means and seal rings of the well tool are retracted from the bore, until the tool is landed therein, and then forced outwardly and held in locked and sealed positions, respectively.

Still another object is to provide such apparatus in which, upon installation of the well tool, the locking means and locking groove in the well bore are protected from the accumulation of debris which might interfere with movement of the locking means into or out of the groove.

A further object is to provide a well tool which is especially well suited to accomplishing the foregoing objects; and, more particularly, to such a well tool which is of simple and inexpensive construction.

These and other objects are accomplished, in accordance with the illustrated embodiment of the present invention, by well apparatus of this type in which the bore of the well conduit has a locking groove thereabout, and in which the well tool includes an inner body adapted to be connected to a running string for movement therewith within the bore, and an outer body on which a locking means is carried for radial movement with respect thereto and a first seal means is carried in position to be expanded into sealing engagement between the outer body and the bore of the well conduit. The outer body is connected to the inner body for movement therewith into a position in which the locking means is radially opposite the locking groove, and a second seal means seals between the inner and outer bodies to cooperate with the first means in preventing flow past the outer body when the first seal means is expanded into sealing position.

A means on the bore of the well conduit is engageable with means on the outer body to limit movement of the outer body with respect to the conduit, when the outer body is so positioned, and the means connecting the inner body to the outer body permits the inner body to be moved with respect to the outer body when movement of the outer body is so limited. More particularly, the inner body has means thereon for moving the locking means outwardly into locking position within the groove and well conduit, in response to initial movement of the inner body with respect to the outer body, and then expanding the first seal means into sealing engagement with the well conduit bore in response to further movement of the inner body with respect to the outer body. In this manner, the well tool is installed within the well bore with a minimum of torque requirements, and with the further assurance that it is locked therein before being sealed with respect thereto.

In the preferred embodiment of the invention, there is a substantially vertical slot in the bore, and a key is carried on the outer body of the well tool for engaging in the slot to limit rotation of the outer body with respect to the conduit when the outer body is positioned with the locking means opposite the locking groove. More particularly, the outer body is threadedly connected to the inner body so that, with the key engaged in the slot, the running string on which the inner body is suspended may be manipulated to rotate the inner body with respect to the outer body and thereby move it vertically with respect thereto to force the locking means and first seal means into locking and sealing positions, as previously described.

In the illustrated embodiment of the invention, there is an upwardly facing shoulder about the bore of the conduit, and the outer body has a downwardly facing shoulder for landing on the shoulder in the bore so as to locate the locking means in the desired position. Also, the locking means comprises a plurality of locking dogs which are yieldably urged to their inner positions as the tool is lowered into and raised from a position in which the locking dogs are opposite the groove. Still further, the key is carried on the outer body for radial movement with respect thereto between an inner position in which it is substantially aligned with the outer circumference of the body, and an outer position for engaging the slot, and a spring means urges the key to its outer position so that it will automatically move into engagement with the slot as the key is moved into a position opposite the slot.

The outer body includes a pair of relatively vertically movable sections having the first seal means disposed between them to support the upper of the sections above the lower, and means are provided on the outer body for engagement with means on the inner body to limit downward movement of the inner body relative to the outer body, following initial downward movement of the inner body to move the locking dogs to locking position, whereby the further downward movement of the inner body causes the outer body sections to be moved axially toward one another in order to radially expand the first seal means between them. The outer body section on which the locking dogs are carried may be a section either above or below the other body section, and thus above or below the first seal means.

Preferably, however, the outer body comprises three relatively vertically movable sections, with the locking dogs carried on the intermediate section, and the first seal means comprises a pair of seal rings each disposed between the intermediate body sections and either the upper or lower section. The inner body has a downwardly facing shoulder which moves downwardly to lower the upper body section in order to radially expand the upper seal ring upon downward movement of the inner body following movement of the locking dogs into the locking groove. Then, when the upper seal ring has been so expanded, continued movement of the inner body will, through the threaded connection between the inner body and the lower body section, raise the landing shoulder on the lower body section above the landing shoulder on the conduit bore so as to radially expand the lower seal ring. Since the pair of seal rings are above and below the intermediate body section on which the locking dogs are carried, they protect the locking dogs and locking groove from debris within the well bore which might otherwise have access thereto between the body and bore. The second seal means also includes a pair of seal rings, one carried by the upper body section and the other by the lower body section, for sealing with the inner body above and below the locking dogs, and thereby preventing the locking dogs from debris which might otherwise have access thereto between the bodies.

Figure 2:
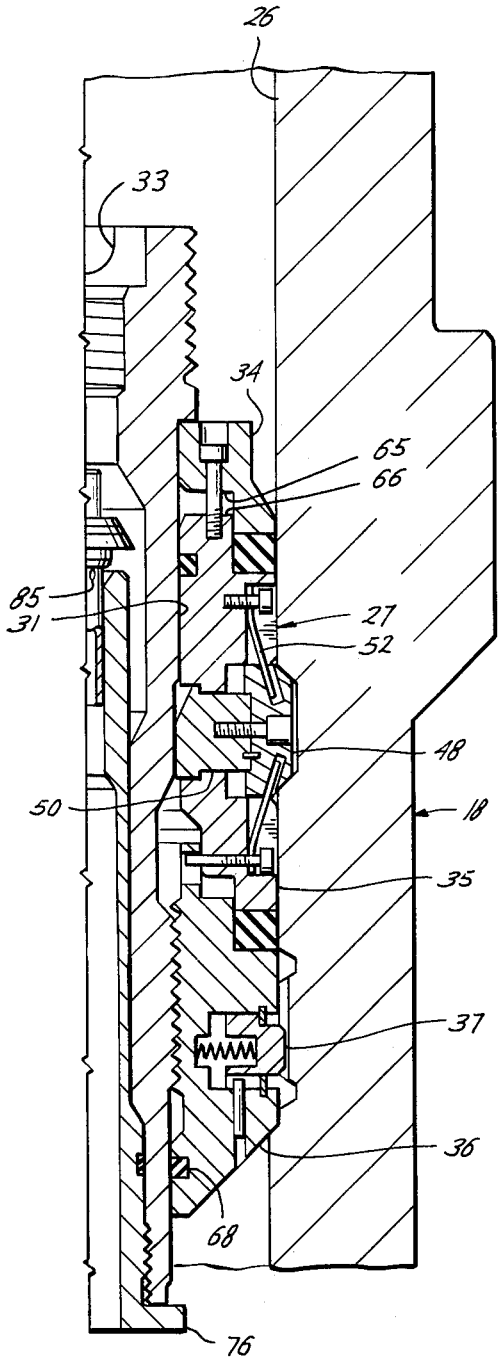
Figure 3:
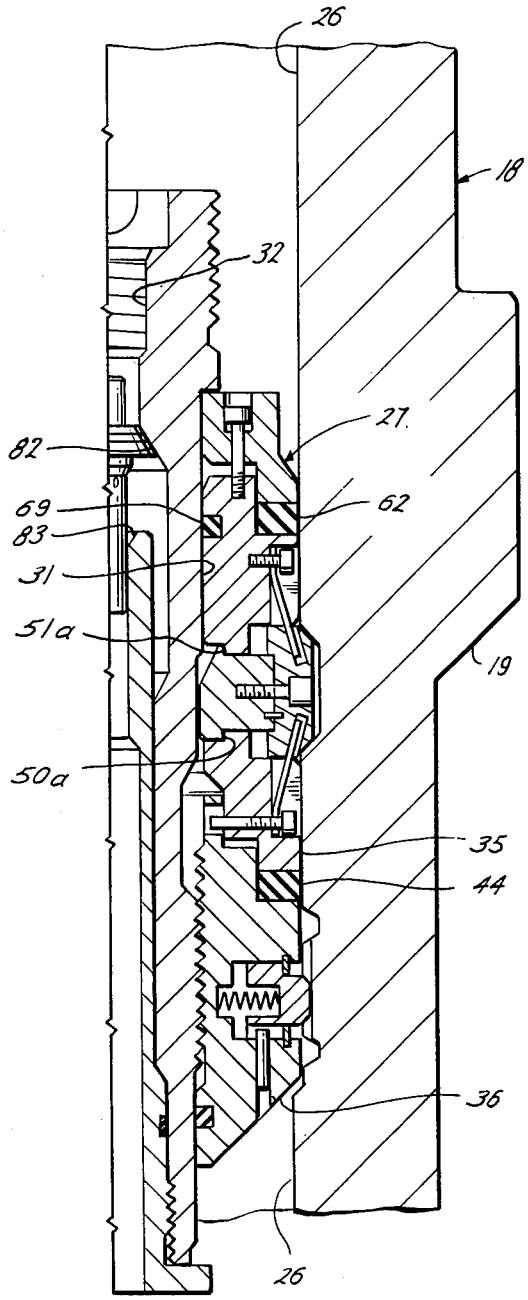

In the drawings:

FIG. 1 is a vertical sectional view of a check valve lowered into the bore of a tubing hanger suspended within a tubing head, one side of the valve being shown in elevation and the other side in vertical cross section and with the locking dogs and seal rings of the valve shown in their retracted positions;

FIG. 2 is an enlarged sectional view of one side of the valve and hanger shown in FIG. 1, but upon lowering of the inner body of the valve so as to move the locking dogs into locking position within a locking groove about the bore of the tubing hanger; and FIG. 3 is a view similar to FIG. 2, but upon further lowering of the inner body to expand the upper and lower seal rings into sealing engagement with the bore.

With reference now to the details of the above-described drawings, the wellhead assembly shown in FIG. 1 comprises a tubing head 10 having a bore 11 therethrough and supported above a casing head 12 with its bore in axial alignment with bore 13 through the casing head. A blowout preventer 14 having a bore 15 therethrough is in turn supported on the upper end of tubing head 10 with its bore in axial alignment with bores 11 and 13 through heads 10 and 12, respectively.

As well known in the art, a casing string 16 is suspended from a casing hanger (not shown) supported in the head 12 for disposal within an outer casing string (not shown) to the upper end of which head 12 is connected. A tubing string 17 is suspended within the casing string by means of a tubing hanger 18 connected to its upper end and landed on seat 20 within bore 11 of the tubing head by means of a shoulder 19 thereabout.

A seal ring 21 carried about the tubing hanger is adapted to seal between it and the bore of the tubing head to close the annulus therebetween. Pins 22 are carried by the tubing head for movement into engagement with a gland nut 23 above the seal ring 21 to expand it into sealing position and hold the hanger down in landed position on seat 20. When preventer 14 is removed and a Christmas tree is installed on head 10, the lower end of a bore through a master valve on the lower end of the tree will fit closely over a seal ring 25 about the upper end of the tubing hanger.

Tubing hanger 18 has a bore 26 therethrough which forms an upward continuation of tubing string 17 suspended from its lower end. As shown in FIG. 1, a check valve 27 has been lowered into a position within the bore to permit it to be first locked therein and then sealed with respect thereto, as illustrated in FIGS. 2 and 3, respectively. Obviously, the particular apparatus shown and described herein is for illustrative purposes only — i.e., the well conduit need not necessarily comprise a tubing hanger, and the well tool need not necessarily comprise a check valve.

In any event, as shown in each of FIGS. 1 to 3, bore 26 of tubing hanger 18 has an upwardly facing shoulder 28 therein on which a landing shoulder about the lower end of valve 27 is adapted to be landed. As will be described in more detail to follow, bore 26 also has a locking groove 29 thereabout into which locking dogs on valve 27 may be moved for locking it in landed position, and a vertical slot 30 therein for receiving a key 37 on the valve when the latter is landed and oriented into a predetermined rotational position with respect to the bore. The portion of bore 26 above landing shoulder 28 is of uniform diameter except for the locking groove, the slot, and annular grooves formed in the bore above and below the slot to facilitate milling of the latter.

Valve 27 includes an inner body 31 having means for connection to a running tool (not shown) on the lower end of a running string which is lowered into the bore 26. Thus, similarly to the valve shown in the aforementioned U.S. Pat. No. 2,939,534, threads 32 are formed on the upper end of a bore through the body 31 to permit it to be connected to the running tool for vertical and rotational movement therewith, and slots 33 are formed in the bore above threads 32 to receive parts on the running tool including a stinger which depresses a valving element in the body (to be described) in order to hold it in an open position. Since suitable running tools of this type are known in the art, and further form no part of the present invention, a detailed description and illustration thereof is unnecessary.

Inner body 31 is surrounded by an outer body made up of upper section 34, intermediate section 35, and lower section 36. The lower section is threadedly connected at 31A about the inner body and thus is supported therefrom for movement within the well bore. The aforementioned key 37 is carried by the lower outer body section 36 so that, when it is engaged within slot 30, as shown in the drawings, the lower body section 36 is held against rotation with respect to tubing hanger 18. In this manner, when valve 27 has been lowered into landed position and then rotated with the running string to bring key 37 into engagement with slot 30, further rotation of the running string will rotate inner body 31 with respect to the outer body and thus cause it to move downwardly therein from the position of FIG. 1.

Key 37 is slidable within a recess 38 in the outer diameter of lower body section 36, whereby it may move radially between an inner position, in which its outer side is substantially flush with the outer circumference of body section 36, and an outer position in which it protrudes therefrom to engage within slot 30. Key 37 is urged outwardly by means of a spring 39 within the recess behind the key, and the key is prevented from moving outwardly beyond its protruding position by means of a snap ring 40. Thus, the key is free to be moved inwardly to its non-protruding position as the well tool is lowered into landed position and rotated within the bore until the key is opposite the slot, at which time it moves outwardly into the slot. The key is of circular cross section for fitting within recess 38 of similar shape; however, its outer end has straight sides which are held in vertical positions for fitting within slot 30 by means of an alignment pin 41.

Intermediate outer body section 35 fits closely about inner body 31, and has stepped flanges on its lower end which fit closely about stepped recesses on the upper end of lower body section 36 so as to guide the intermediate section for vertical movement with respect to the lower section. A seal ring 44 of rubber or other suitable material is contained within a space formed by the lower end of outer flange 42 on body section 35 and the adjacent walls of outer recess 43 on body section 36. The lower end of the inner flange is spaced above the upper surface of the inner recess so that, as shown in FIGS. 1 and 2, the intermediate body section is free to move downwardly with respect to the lower section in order to radially expand the seal ring outwardly into sealing engagement with the hanger bore, as will be described below.

A series of locking dogs 47 are carried by intermediate body section 35 for radial movement between the inner positions shown in FIG. 1 and the outer positions shown in FIGS. 2 and 3. More particularly, the unexpanded seal ring 44 supports the locking dogs in a position opposite locking groove 29 in the bore of the tubing hanger when the tubing hanger has been lowered into the landed position of FIG. 1, whereby they may be moved outwardly from their inner positions to their outer positions within such groove.

Each dog includes an outer arcuate part 48 having its upper and lower ends closely received and slidable within a recess 49 formed about body section 35, and stems 50 which are bolted to parts 48 and extend slidably through radial holes 51 in the body section. The dog parts 48 are urged to their inner positions shown in FIG. 1, in which their outer sides are flush with the outer circumference of body section 35, by means of leaf springs 52 mounted within slots 53 formed in the body 35 above and below the recess 49. The springs are held in the slots by means of screws **53*a*, and their free ends are slidably received within slots 54 formed in the upper and lower ends of the arcuate parts 48 of the locking dogs. The dogs are prevented from moving beyond their outermost locking positions, as shown in FIGS. 2 and 3, by an annular shoulder 50*a* on the innermost ends of stems 50 engageable with an annular shoulder 51*a* formed about the inner end of each hole 51**.

A hole 55 is formed in the vertical wall of the inner recess on the uppermost end of lower body section 36, and lower screws **53*a* have inner extensions 56 which fit within hole 55 to prevent intermediate body 35 from rotating with respect to lower body section 36. At the same time, hole 55 is of sufficient vertical extent that screw extension 56 may move vertically therein as lower body section 36 moves upwardly with respect to intermediate body section 35 during expansion of seal ring 44**, as will be described.

Upper body section 34 has an outer flange 60 on its lower end which fits closely about a recess 61 on the upper end of intermediate body section 35 so as to guide section 34 for vertical movement with respect to section 35. Also, a seal ring 62 of rubber or similar material fits closely within a space formed between the lower end of flange 60 and adjacent faces of recess 61. Seal ring 62 supports a shoulder 65 about body section 34 above a shoulder 66 on the upper end of body section 35, so that the upper body section 34 may be urged downwardly to expand seal ring 62 upwardly into sealing engagement with the bore 26 of the tubing hanger, as will be described below.

Upper body section 34 is connected to and held against rotation with respect to intermediate body section 35, and thus with respect to lower body section 36, by means of bolts 67 which extend downwardly from shoulder 65 for connection with threaded holes in shoulder 66. As shown, the upper end of each bolt 67 is free to slide within a hole in the upper end of body section 34 so as to permit the latter to move vertically downwardly with respect to body section 35 from the position shown in FIG. 1. The enlargement on the upper end of bolt 67 limits upward movement of body section 34 with respect to intermediate body section 35.

A seal ring 68 is carried by the inner diameter of section 36 for sealing about the lower end of body 31 beneath threaded connection 31A, and thus below locking dogs 47, and a seal ring 69 is carried by the inner diameter of section 35 for sealing about body 31 above the locking dogs. Thus, upon expansion of seal rings 44 and 62 into sealing engagement with the bore 26, as shown in FIG. 3, seal rings 68 and 69 cooperate therewith to not only close off the annular space between the inner body and the bore, but also protect the locking dogs and locking recess 29 from debris within the bore.

A recess 70 in the outer circumference of the inner body 31 is generally opposite the inner ends of locking dogs 47, when the inner body is in landed position, as shown in FIG. 1. A downwardly and inwardly tapered cam surface 71 on the upper end of the recess is disposed above a cam follower surface 72 on the upper ends of the locking dogs to force them radially outwardly from their inner positions to their outer positions upon lowering of inner body 31 with respect to the outer body. As the inner body moves into the lower position of FIGS. 2 and 3, the cylindrical surface on its outer circumference above cam surface 71 slides downwardly behind the cylindrical inner surfaces of locking dogs 47 to positively hold them in their outer positions.

As previously described, inner body 31 is lowered with respect to the locking dogs by rotation of the inner body after the outer body has been landed on shoulder 28 and rotated into the position shown in FIG. 1 wherein it is held against rotation by key 37. Although the downward force exerted by cam surface 71 against cam surface 72 will be transmitted to seal ring 44, it is not sufficient to expand the seal ring into sealing engagement with the bore 26 of the tubing hanger. Furthermore, the upper end of body 31 is enlarged to provide a downwardly facing shoulder 75 which is spaced above the upper end of upper body section 34, when the inner body 31 is in its uppermost position with respect to the outer body, as shown in FIG. 1, to prevent engagement of shoulder 75 with the upper end of body section 34 until the inner body 31 has been lowered sufficiently to move the locking dogs outwardly into and then hold them in locking position. However, additional downward movement of the inner body in response to further rotation of running string forces shoulder 75 downwardly against the upper end of body section 34, and since intermediate body section 35 is held against downward movement by virtue of the fact that locking dogs 47 are engaged within locking groove 29, the lower end of flange 60 moves downwardly to expand seal ring 62 outwardly into engagement with bore 26.

As seal ring 62 is expanded, it resists further downward movement of upper body section 34 so that, upon continued rotation of inner body 31, threaded connection 31A causes lower body section 36 to move upwardly. Since intermediate body section 35 is also held against upward movement by virtue of the engagement of locking dogs 47 within locking groove 29, this upward movement of body section 36 with respect to intermediate body section 35 will expand seal ring 44 radially outwardly into sealing engagement with bore 26. In this respect, it will be noted from FIG. 3 that body section 36, and thus the landing shoulder on its lower end, are free to move upwardly with respect to bore 26 and thus from the landing shoulder 28 therein, and that slot 30 is of sufficient length that key 37 is held therein during this upward movement.

Engagement of the aforementioned parts of the running tool within slots 33 enables the running string to be rotated in the opposite direction to raise the inner body and thus permit seal rings 44 and 62 to retract from sealing engagement with bore 26, and locking dogs 47 to be withdrawn from locking groove 29, continued upward movement of the inner body relative to the outer body being limited by engagement of a flange 76 about its lower end with the lower end of lower body section 36. As shown in FIG. 1, when retracted, the outer surfaces of the locking dogs 47 as well as the outer surfaces of the seal rings 44 and 62 are substantially flush with the vertically aligned outer circumferences of the upper, intermediate and lower body sections. Thus, during raising and lowering of the valve from and into its landed position, the locking dogs and seal rings do not protrude from the valve.

Inner body 31 is made up of outer tubular section 77 about which the outer body is disposed, and inner tubular section 78 telescopically disposed within the outer tubular section. Thus, as can be seen from the drawings, the inner and outer sections form a bore through the valve body which is controlled by a valving element mounted therein, as described below. Inner section 78 is held within outer section 77 by the connection of threads about its lower end above flange 76 with threads about the inside lower end of the outer section.

A valving element 80 mounted within the bore includes a lower stem 81 slidable within the upper end of inner section 78 to guide it for vertical reciprocation between an upper position (FIG. 3) in which a head on its upper end seats upon a downwardly facing seat 82 in outer section 77, so as to prevent flow in an upward direction, and a lower position in which it seats on a seat 83 about the upper end of lower section 78 so as to prevent flow in a downward direction. As shown in FIG. 2, the stem is hollow and has ports 85 in its upper end which connect its inner diameter with its outer diameter and thus with the space about the stem when the valving element is lifted above its lower position.

As previously mentioned, the double acting valve 27 may be used either as a back pressure valve to control the fluid within tubing 17, when the Christmas tree is removed from the wellhead, or to prevent flow downwardly therethrough in pressure testing the Christmas tree. Thus, as the valve is being lowered into the bore 26 and rotated to cause it to be locked with and sealed with respect to bore 26, a stinger on the above-described running tool depresses the valving element to hold it in the open position of FIGS. 1 and 2, and thereby equalize pressure thereacross. Then, when the valve is so installed, the running tool may be disconnected from threads 32 and raised therefrom with the running string, thereby lifting the stinger from the valving element to permit it to be moved upwardly to closed position (FIG. 3) due to well pressure therebelow. Then, of course, upon reconnection of the running tool to the valve preparatory to removing it from the bore of the tubing hanger, the stinger again depresses the valving element to equalize pressure across the valve before the running tool is manipulated to permit the seal rings and locking dogs to be retracted.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

The invention having been described, what is claimed is:

1. Well apparatus, comprising a well conduit having a bore therethrough and a locking groove about the bore, a well tool including an inner body adapted to be connected to a running string for movement therewith within the bore, an outer body including first and second outer body sections, locking means carried by the first outer body section for radial movement with respect thereto, means connecting the outer body to the inner body for movement therewith into a position in which the locking means is radially opposite the locking groove, means on the bore engageable with means on the outer body to limit movement of said outer body with respect to the conduit when the outer body is so positioned, said connecting means permitting said inner body to be moved with respect to the outer body when movement of said outer body is so limited, first seal means carried by and disposed about the outer body in position to be expanded into sealing engagement between said outer body and the bore of the well conduit in response to vertical movement of said second section relative to said first section, means on the inner body for moving the locking means outwardly into locking position within the groove in the well conduit in response to initial movement of said inner body with respect to said outer body and independently of relative vertical movement of said outer body sections, and then engaging said second body section to move it vertically with respect to the first body section and thereby expand the first seal means into sealing engagement with the well conduit bore in response to further movement of said inner body with respect to said outer body, and second seal means for sealing between said inner and outer bodies so as to cooperate with said first seal means in preventing flow past said outer body.

2. Well apparatus of the character defined in claim 1, wherein said locking means comprises a plurality of locking dogs.

3. Well apparatus of the character defined in claim 1, wherein each of said first and second seal means includes seal rings above and below said locking means.

4. Well apparatus, comprising a well conduit having a bore therethrough, a locking groove about the bore, and a substantially vertical slot in the bore, a well tool including an inner body adapted to be connected to a running string for movement therewith within the bore, an outer body, locking means carried by the outer body for radial movement with respect thereto, means threadedly connecting the outer body to the inner body for movement therewith into a position in which the locking means is radially opposite the locking groove, a key carried on the outer body for engaging in the slot in the bore to limit rotational movement of said outer body with respect to the conduit when so positioned, said connecting means permitting said inner body to be rotated and thereby moved vertically with respect to said outer body when rotational movement of said outer body is so limited, first seal means carried by and disposed about the outer body in position to be expanded radially into sealing engagement between said outer body and the bore of the well conduit, means on the inner body for moving the locking means outwardly into the locking groove in the well conduit in response to initial vertical movement of said inner body with respect to said outer body, and then expanding the first seal means radially into sealing engagement with the well conduit bore in response to further vertical movement of said inner body with respect to said outer body, and second seal means for sealing between said inner and outer bodies so as to cooperate with said first seal means in preventing flow past said outer body.

5. Well apparatus of the character defined in claim 4, wherein said locking means comprises a plurality of locking dogs.

6. Well apparatus of the character defined in claim 4, wherein each of said first and second seal means includes seal rings above and below said locking dogs.

7. Well apparatus of the character defined in claim 4, wherein the bore of said conduit has an upwardly facing shoulder therein, and said outer body has a downwardly facing shoulder for landing on the shoulder in the bore to locate said locking means radially opposite the locking groove.

8. Well apparatus, comprising a well conduit having a bore therethrough, a locking groove about the bore, and a substantially vertical slot in the bore below the groove, a well tool including an inner body adapted to be connected to a running string for movement therewith within the bore, an outer body threadedly connected to the inner body to permit it to be moved therewith within the well conduit, said outer body including a pair of relatively vertically movable sections having a seal ring disposed therebetween to support the upper of said sections above the lower, a plurality of locking dogs carried by one of the outer body sections for radial movement with respect thereto and adapted to be lowered with said outer body section into a position radially opposite said locking groove, said outer body having a key thereon engageable with the slot in the well conduit bore, when the locking dogs are so positioned, so that said inner body may be rotated in order to move it downwardly with respect to said outer body in response to manipulation of said running string, means on the inner body engageable with said locking dogs for moving them outwardly into the groove upon initial downward movement of said inner body with respect to said outer body, means on the outer body engageable with means on the inner body to limit downward movement of said inner body relative to the other outer body section, following initial downward movement of said inner body, whereby further downward movement of said inner body relative to said outer body causes said outer body sections to be moved axially toward one another in order to radially expand the seal ring into sealing engagement with said well conduit bore, and means sealing between said inner and outer bodies so as to cooperate with said seal ring in preventing flow past said outer body when said seal ring is sealably engaged with the bore.

9. Well apparatus of the character defined in claim 8, wherein the one outer body section on which the locking dogs are carried is below the other body section.

10. Well apparatus of the character defined in claim 8, wherein the one outer body section on which the locking dogs are carried is above the other body section.

11. Well apparatus of the character defined in claim 8, including means yieldably urging said locking dogs to an inner position.

12. Well apparatus of the character defined in claim 8, wherein the bore of said conduit has an upwardly facing shoulder therein, and said outer body has a downwardly facing shoulder for landing on the shoulder in the bore to locate said locking dogs radially opposite the locking groove.

13. Well apparatus, comprising a well conduit having a bore therethrough, a locking groove about the bore, and a substantially vertical slot in the bore below the groove, a well tool including an inner body adapted to be connected to a running string for movement therewith within the bore, an outer body including a lower section threadedly connected to the inner body to permit the lower section to be moved therewith within the bore, an intermediate section surrounding the inner tool body above the lower section, and an upper section surrounding the inner tool body above the intermediate section, a plurality of locking dogs carried by the intermediate outer body section for radial movement with respect thereto and adapted to be lowered with said outer body into a position radially opposite said locking groove, a lower seal ring disposed between shoulders about the lower and intermediate sections to support said intermediate section spaced above said lower section, an upper seal ring disposed between shoulders about the intermediate and upper sections to support said upper section spaced above said intermediate section, said lower body section having a key thereon engageable within the slot in the well conduit bore, when the locking dogs are so positioned, so that inner body may be rotated in order to move it downwardly with respect to said outer body in response to manipulation of said running string, said inner body having means thereon engageable with the locking dogs for moving them outwardly into the groove upon initial downward movement of said inner body with respect to said outer body, and a downwardly facing shoulder which lowers the upper outer body section and thereby radially expands the upper seal ring toward sealing engagement with said well conduit bore upon continued downward movement of the inner body with respect to the outer body, whereby upon further lowering of said inner body following expansion of said upper seal ring, the landing shoulder on said lower body section is raised above the landing shoulder on the conduit bore so as to radially expand said lower seal toward sealing engagement with said well conduit bore, and means sealing between said inner and outer bodies above and below said locking dogs.

14. Well apparatus of the character defined in claim 13, including means holding said intermediate and upper outer body sections against rotation with said inner body.

15. Well apparatus of the character defined in claim 13, including means on the intermediate body section yieldably urging said locking dogs to their inner positions.

16. Well apparatus of the character defined in claim 13, wherein the key is mounted on the lower body section for radial movement between an outer position to engage within the slot and an inner position within the bore, and means are mounted on the lower body section for yieldably urging the key to its outer position.

17. Well apparatus of the character defined in claim 13, including spring means yieldably urging said locking dogs to an inner position.

18. Well apparatus of the character defined in claim 13, wherein the bore of said conduit has an upwardly facing shoulder therein, and said outer body has a downwardly facing shoulder for landing on the shoulder in the bore to locate said locking dogs radially opposite the locking groove.

19. A well tool adapted to be locked within sealed with respect to the bore of a well conduit, said well tool including an inner body adapted to be connected to a running string for movement therewith within the bore, an outer body including first and second body sections, a plurality of locking dogs carried by the first outer body section for radial movement with respect thereto between an inner position substantially flush with the outer circumference of said outer body and an outer locking position protruding therefrom, means connecting the outer body to the inner body for movement therewith, said connecting means permitting manipulation of said running string to move said inner body with respect to said outer body when movement of said outer body with respect to said bore is limited, first seal means carried about the outer body in position to be expanded radially outwardly from a normally retracted position substantially flush with the outer circumference of said outer body into a sealing position in response to vertical movement of said second section relative to said first section, means on the inner body for moving the locking dogs to their locking positions in response to initial movement of said inner body with respect to said outer body and independently of relative vertical movement of said outer body sections, and for then engaging said second body section to move it vertically with respect to the first body section and thereby expand the first seal means into sealing engagement with the well conduit bore in response to further movement of said inner body with respect to said outer body, and second seal means for sealing between said inner and outer bodies so as to cooperate with said first seal means in preventing flow past said outer body.

20. A tool of the character defined in claim 19, including spring means on the outer body yieldably urging the locking dogs to their inner positions.

21. A well tool adapted to be locked within and sealed with respect to the bore of a well conduit, said well tool including an inner body adapted to be connected to a running string for movement therewith within the bore, an outer body threadedly connected to the inner body to permit it to be moved therewith, said outer body including a pair of relatively vertically movable sections having a seal ring disposed therebetween to support the upper of said sections above the lower, said seal ring being expandible between an inner position in which its outer diameter is substantially flush with the outer circumference of said outer body sections and an expanded position in which it protrudes therefrom, a plurality of locking dogs carried by one of the outer body sections for radial movement with respect thereto between an inner position substantially flush with the outer circumferences of said body sections and an outer position protruding therefrom, said outer body having a key thereon adapted to engage within a vertical slot in the well conduit bore, when the locking dogs are so positioned, so as to hold said outer body against rotation and thereby permit said inner body to be rotated in order to move it downwardly with respect to said outer body in response to manipulation of said running string, means on the inner body engageable with said locking dogs for moving them outwardly into the locking positions upon initial downward movement of said inner body with respect to said outer body, means on the outer body engageable with means on the inner body to limit downward movement of said inner body relative to the other outer body section, following downward movement of said inner body to move the dogs into locking position, whereby further downward movement of said inner body causes said outer body sections to be moved axially toward one another in order to move the seal ring into expanded position, and means sealing between said inner and outer bodies so as to cooperate with said expanded seal ring in preventing flow past said outer body.

22. A tool of the character defined in claim 21, including spring means on the outer body yieldably urging the locking dogs to their inner positions.

23. A well tool adapted to be locked within and sealed with respect to the bore of a well conduit, said well tool including an inner body adapted to be connected to a running string for movement therewith, an outer body including a lower section threadedly connected to the inner body to permit the lower section to be moved therewith, an intermediate section surrounding the inner body above the lower section, and an upper section surrounding the inner tool body above the intermediate section, a plurality of locking dogs carried by the intermediate outer body section for radial movement with respect thereto between inner positions substantially flush with the outer circumferences of the body sections and outer positions protruding therefrom, a lower seal ring disposed between shoulders about the lower and intermediate sections to support said intermediate section spaced above said lower section, an upper seal ring disposed between shoulders about the intermediate and upper sections to support said upper section spaced above said intermediate section, each of said seal rings being normally retracted into a position in which its outer diameter is substantially flush with the outer circumferences of said body sections, said lower body section having a key carried thereon for radial movement between an inner position in which its outer circumference is substantially flush with the outer circumferences of the body sections, and an outer position in which it protrudes from the outer circumference of said body sections, said key being adapted to engage within a slot in the well conduit bore, when in its outer position, so as to hold said lower body section against rotation with the inner body and thereby permit said inner body to be rotated in order to move downwardly with respect to said outer body in response to manipulation of said running string, said inner body having means thereon engageable with the locking dogs for moving them into their outer positions upon initial downward movement of said inner body with respect to said outer body, and a downwardly facing shoulder which moves downwardly to lower the upper outer body section and thereby radially expand the upper seal ring upon downward movement of the inner body with respect to the outer body, whereby upon further lowering of said inner body following expansion of said upper seal ring, the landing shoulder on said lower body section is raised so as to expand said lower seal, and means between said inner and outer bodies above and below said locking dogs.

24. A tool of the character defined in claim 23, including spring means on the outer body yieldably urging the locking dogs to their inner positions.

25. A tool of the character defined in claim 23, including means yieldably urging the key to its outer position.

26. A tool of the character defined in claim 24, including means yieldably urging the key to its outer position.

* * * * *